US010647114B2

(12) United States Patent
Lee et al.

(10) Patent No.: US 10,647,114 B2
(45) Date of Patent: May 12, 2020

(54) CONTINUOUS INKJET PRINTERS

(71) Applicant: Domino UK Limited, Cambridge (GB)

(72) Inventors: Daniel John Lee, Huntingdon (GB); Simon Brierley, Cambridge (GB); Christopher Adrian Chapman, Cambridge (GB)

(73) Assignee: Domino UK Limited, Cambridge (GB)

( * ) Notice: Subject to any disclaimer, the term of this patent is extended or adjusted under 35 U.S.C. 154(b) by 0 days.

(21) Appl. No.: 16/318,150

(22) PCT Filed: Jul. 18, 2017

(86) PCT No.: PCT/GB2017/052101
§ 371 (c)(1),
(2) Date: Jan. 16, 2019

(87) PCT Pub. No.: WO2018/015730
PCT Pub. Date: Jan. 25, 2018

(65) Prior Publication Data

US 2019/0217609 A1 Jul. 18, 2019

(30) Foreign Application Priority Data

Jul. 18, 2016 (GB) ..... 1612420.8

(51) Int. Cl.

| | |
|---|---|
| ***B41J 2/095*** | (2006.01) |
| ***B41J 2/02*** | (2006.01) |
| ***B41J 29/393*** | (2006.01) |
| ***B41J 2/125*** | (2006.01) |
| ***B41J 2/09*** | (2006.01) |

(52) U.S. Cl.
CPC ..... *B41J 2/095* (2013.01); *B41J 2/02* (2013.01); *B41J 2/09* (2013.01); *B41J 2/125* (2013.01); *B41J 29/393* (2013.01)

(58) Field of Classification Search
CPC ..... B41J 2/02; B41J 2/07; B41J 2/09; B41J 2/125; B41J 2/095; B41J 29/393; B41J 2002/022; B41J 2002/033
See application file for complete search history.

(56) References Cited

U.S. PATENT DOCUMENTS

| | | | | |
|---|---|---|---|---|
| 4,119,973 | A | 10/1978 | Stager | |
| 4,573,057 | A | 2/1986 | Sutera et al. | |
| 2010/0033543 | A1* | 2/2010 | Piatt et al. | 347/77 |

FOREIGN PATENT DOCUMENTS

| | | | |
|---|---|---|---|
| EP | 1013420 | A2 | 6/2000 |
| GB | 2461014 | A | 12/2009 |

OTHER PUBLICATIONS

Matthew Tomlin, May 19, 2016, CIJ EHT Faults/HV Trips, Linkedin [Online], Available from: https://www.linkedin.com/pulse/cij-eht-faultshv-trips-matthew-tomlin, see slides.

* cited by examiner

*Primary Examiner* — Juanita D Jackson
(74) *Attorney, Agent, or Firm* — Price Heneveld LLP

(57) ABSTRACT

The invention describes a method and apparatus for characterising EHT tripping events and thus discriminating between false trip events and those that warrant the printer being shut down.

2 Claims, 2 Drawing Sheets

CONTINUOUS INKJET PRINTERS

FIELD OF THE INVENTION

This invention relates to continuous inkjet ('CIJ') printers and, in particular, to a process of and means for detecting trip conditions associated with arcing across charged deflector plates of a CIJ printer.

BACKGROUND TO THE INVENTION

CIJ printers are widely used to place identification codes on products. Typically a CIJ printer includes a printer housing that contains a system for pressurising ink; a print head located at or close to a point which items to be coded pass; and a conduit containing fluid and electrical connections linking the printer housing and the printhead. In operation, ink is pressurised in the printer housing and then passed, via an ink feed line in the conduit, to the printhead. At the printhead the pressurised ink is passed through a nozzle to form an ink jet. A vibration or perturbation is applied to the ink jet causing the jet to form into into a stream of droplets, a process known as break-up.

The printer includes a charge electrode to charge selected droplets; and an electrostatic facility, typically a spaced pair of conductive plates held at different potentials to create an extra high tension (EHT) field there-between. Those droplets that are charged are deflected by the EHT field away from their original trajectory and onto a substrate. By controlling the amount of charge that is placed on droplets, the trajectories of those droplets can be controlled to form a printed image.

A continuous inkjet printer is so termed because the printer forms a continuous stream of droplets irrespective of whether or not any particular droplet is to be used to print.

The printer selects the drops to be used for printing by applying a charge to those drops, these drops then being deflected by the electrostatic facility to subsequently impact a substrate. Uncharged drops are not affected by the electrostatic facility and continue, on the same trajectory as they were jetted from the nozzle, into a catcher or gutter.

The unprinted drops collected in the gutter are returned from the printhead to the printer housing via a gutter line included in the conduit. Ink, together with entrained air, is generally returned to the printer housing under vacuum, the vacuum being generated by a pump in the gutter line.

During operation of a CIJ printer, it is common for ink to build up around the printhead area. By way of example, micro-satellites associated with the break-up can be attracted to the deflector plates, or to the gutter. Over time this build-up can reduce the air gap between the deflector plates, or between one plate and ground, leading to arcing which in turn causes break-down of the EHT field.

Typically CIJ printers have a sensing facility to detect this arcing, initiate removal of the voltage supply to the plates, and then shut-down the printer. This avoids print quality being adversely affected. However a problem can arise in that the detection of this expected arcing can be confused with other sources of electrostatic discharge. For example, an operator holding a static charge may discharge himself by touching a metallic part of the printer. Such confusion is undesirable as the machine may shut-down when it is not valid or necessary, leading to a loss of operational effectiveness.

It is an object of the invention to provide a method of and means for addressing the above problem; or at least to provide a novel and useful choice.

SUMMARY OF THE INVENTION

Accordingly, in one aspect, the invention provides a method of controlling a continuous inkjet printer having an electrostatic deflection facility operable to create an EHT field to deflect charged ink droplets; a power unit operable to power said electrostatic facility; and a control unit operable to enable said power unit, said method comprising configuring said control unit to detect an electrostatic trip event and, in the event of a trip event being detected, to disable said power unit, said method being characterised by configuring said control unit to distinguish between a true trip event and a false trip event by comparing each trip event with one or more measures distinguishing a true trip event with a false trip event.

Preferably said one or more measures include time measures.

Preferably said method comprises comparing the time period of a trip event with a first pre-determined time period.

Preferably said method comprises comparing the time between successive trip events with a second pre-determined time period.

In a second aspect, the invention provides a continuous inkjet printer having an electrostatic deflection facility operable to create an EHT field to deflect charged ink droplets; a power unit operable to power said electrostatic facility; and a control unit operable to enable said power unit, said control unit being configured to detect an electrostatic trip event and, in the event of a trip event being detected, to disable said power unit, said printer being characterised in that said control unit is configured to distinguish between a true trip event and a false trip event by comparing each trip event with one or more measures distinguishing a true trip event from a false trip event.

Preferably said one or more measures include time measures.

Preferably a first time measure comprises the time period of a trip event.

Preferably a second time measure comprises a time between successive trip events.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

An embodiment of the invention will now be described with reference to the accompanying drawings in which.

DESCRIPTION OF WORKING EMBODIMENT

This invention is concerned with EHT tripping or arcing in a CIJ printer. More particularly we have found that, by carefully characterising true or legitimate EHT trip events, we can use this as a basis for assessing all EHT discharge events, and thereby discriminate between true EHT trip events and false EHT trip events.

In this context a true EHT trip event is one arising from a deterioration in operating conditions that, in turn, would inevitably lead to a deterioration in print quality. An example of this is a trip arising from build-up of ink residue on the deflector plates that, in turn, reduces the air gap between the plates. A false EHT trip event is a 'one-off' event detected by the trip sensing system which, in general, is non-repeating and is therefore unlikely to result in a deterioration of print quality. One example of a false trip event is an event sensed by the EHT sensing system when an electrostatically charged operator discharges himself by touching a metallic part of the printer.

We have found that a key characteristic of a falsely detected trip condition is a short duration voltage pulse observed at the EHT trip detector. The identification of this characteristic has been used to determine appropriate criteria for a true trip condition.

Figure 1:
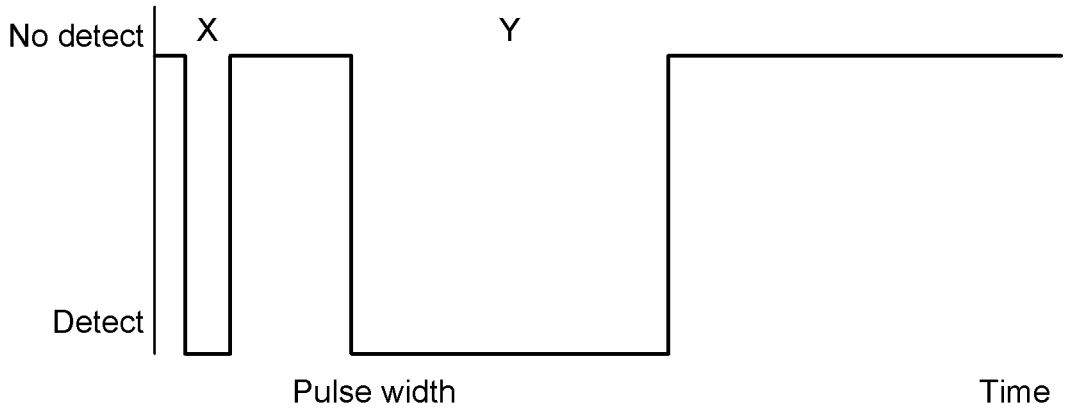
FIG. 1: shows examples of criteria used according to the invention to distinguish between false and true electrostatic trip events.

Referring to FIG. 1, two criteria, X and Y, used to detect the validity of a trip condition are shown. The pulse of width X is of short duration which is typically indicative of a false trip event. Pulse Y, of longer duration, is typically indicative of a true trip event. It will be appreciated that X and Y (or at least a minimum value of Y or a maximum value of X) can be established in the printer control system whereupon comparisons can subsequently be made in real time, with the characterised values, to discriminate between false and true trip events.

Additionally, as will be described below in relation to FIG. 4, the time period between trip events and/or the time period over which a number of qualifying signals need to be seen can be set in the control system so as to further aid the discrimination.

Figure 2:
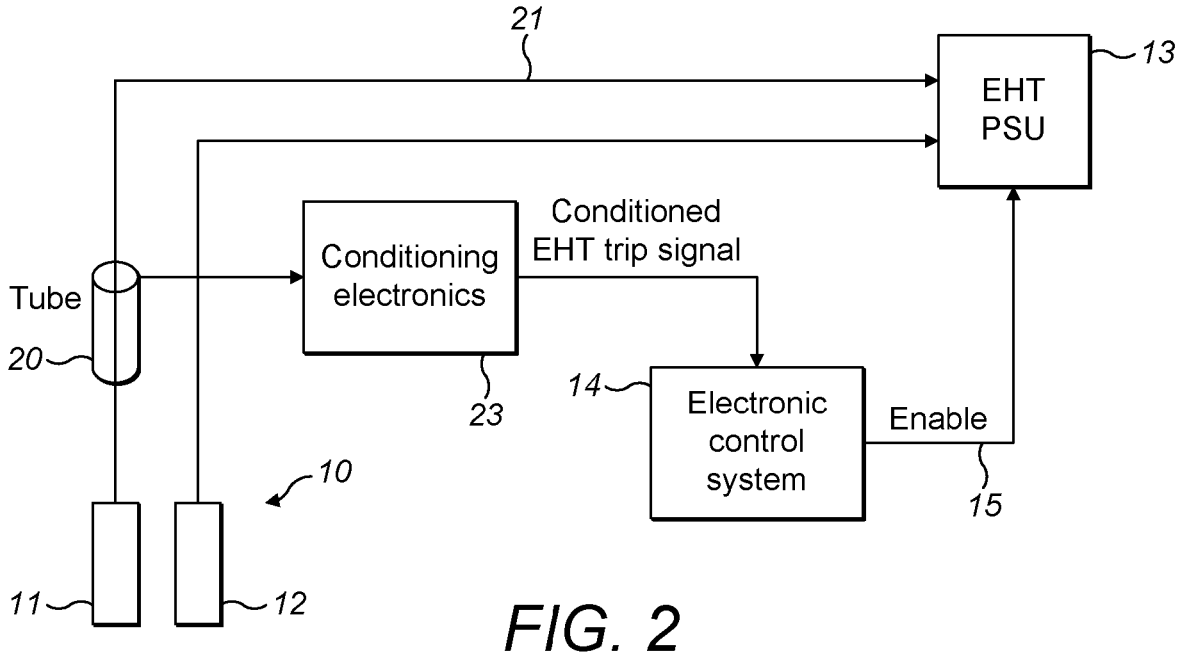
FIG. 2: shows a system block diagram suitable for implementing the invention.

Referring now to FIG. 2, part of a CIJ printer system includes an electrostatic deflection facility 10 in the form of positive plate 11 and negative plate 12. The deflection plates 11 and 12 are connected by wires to a high-voltage power supply unit 13. The power supply unit 13 is controlled by an electronic control unit 14 that, in normal operation, outputs an enable signal 15 causing an EHT deflection field to be generated between the plates 11 and 12. A pulse detection unit is provided, in this case in the form of a metal tube 20 through which passes the wire 21 connecting the power supply unit 13 to the positive plate 11. The tube 20 forms a capacitive sensor, such that voltage transients on the wire 21, representative of EHT trip signals, are coupled into the tube. The pulse detection unit may be of the form described in our European Patent Application No. 1 129 854. The tube 20 is electrically connected to conditioning electronics 23 in which the capacitively coupled signal from the tube 20 is subjected to threshold detection and voltage limitation so as to form a digital signal which is passed to, and processed by, electronic control unit 14.

Figure 3:
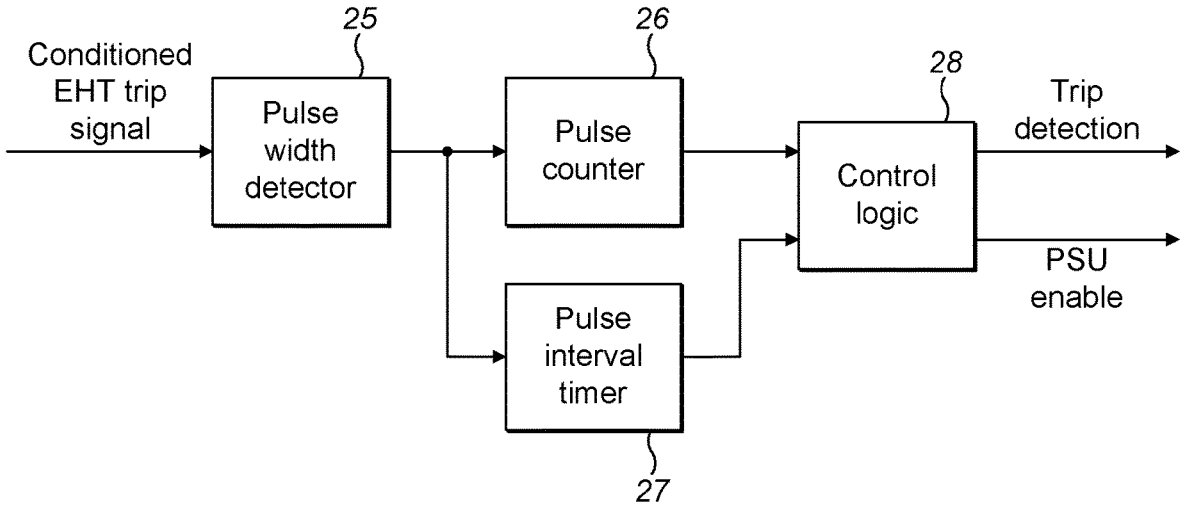
FIG. 3: shows a control system block diagram which may be included in the system shown in FIG. 2.

Referring to FIG. 3, the conditioned EHT trip signal passes through a pulse width detector 25, the output of which is fed to a pulse counter 26 and a pulse interval timer 27. The output signals, in turn, from counter 26 and timer 27 are fed into control logic 28 which is configured to determine if the number of pulses of the required widths have been detected to constitute a true EHT trip event. If the logic 28 determines that the detection criteria have been met, a signal is output causing power supply unit 13 to be switched off.

By way of example only, a pulse interval for two qualifying pulses may be 50 ms, while a pulse-width for qualifying or true pulses may be a minimum of 800 ns. In addition to the pulse-width criterion for one of the pulses, it is normal to define a minimum pulse width for a second or indeed all subsequent pulses in order to reject glitches. An example of this period may be 50 ns but the point is made that the order of wide and narrow pulses can be either way around: narrow then wide or wide then narrow.

The control logic may be effected using an FPGA device to perform the pulse width measurement and, for the pulse counting, a simple state machine may, for example, be used.

Figure 4:
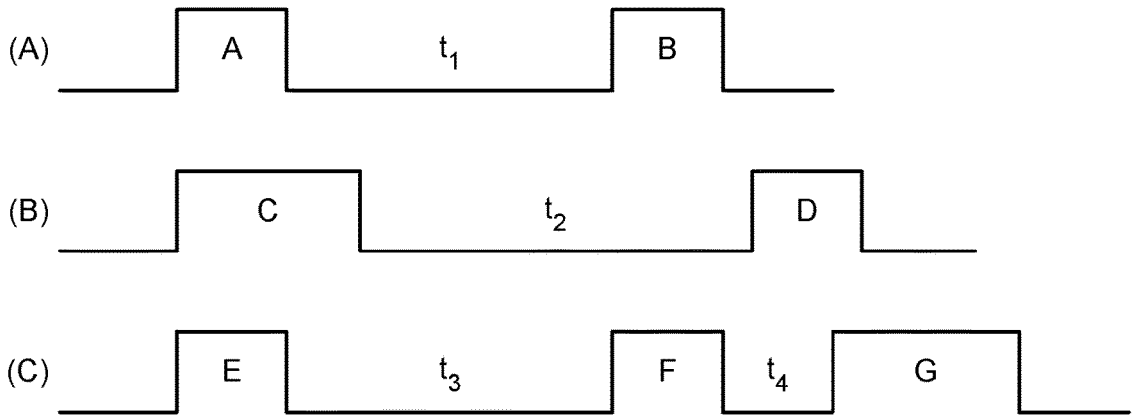
FIG. 4: shows examples of true and false electrostatic pulses as determined according to the invention

Referring now to FIG. 4, a number of typical pulse detection criteria are shown. Whilst, for convenience of explanation, time intervals between pulses are shown, the logic may be configured to determine time intervals between the start of each pulse or the number of qualifying pulses (pulses of a particular length) in a given time interval.

In FIG. 4*a*, pulses A and B, separated by time interval $t_1$ are shown. Both A and B do not meet the minimum pulse width specified and, further, the time $t_1$ is sufficiently long that even if either A or B qualified in terms of pulse width, the situation shown in FIG. 4(A) would still be regarded as a false trip and would not lead to a machine shut-down. Expressed in an alternative manner, the number of qualifying pulses are not present in a qualifying time period.

In FIG. 4(B) pulses C and D are separated by time $t_2$. Pulse C is of sufficient width to be a qualifying pulse but time interval $t_2$ is of sufficient length to ensure that two qualifying pulses are not present with a qualifying time period. Thus the situation shown in FIG. 4(B) would also be regarded as a false trip.

In FIG. 4(C) three pulses E, F and G are shown, E and F being separated by time interval $t_3$ and F and G being separated by time interval $t_4$. In this example pulses E and F do not meet the minimum width threshold and are thus non-qualifying. Pulse G meets the minimum width requirement and is thus a qualifying pulse. Because t3 is long the combination of E and F alone would not constitute a true trip event but combination of qualifying pulse G and t4 within the threshold time limit gives rise to a true trip event. By way of example, to constitute a true trip we need one pulse of >50 ns followed by one of >800 ns within the threshold time interval; or one >800 ns followed by one of >50 ns within the threshold time interval. Thus the scenario shown in FIG. 4*c* would cause a shut down of the power supply unit 13 and, ultimately, the printer.

The invention claimed is:

1. A method of controlling a continuous inkjet printer having an electrostatic deflection facility operable to create an extra high tension (EHT) field to deflect charged ink droplets; a power unit operable to power said electrostatic facility; and a control unit operable to enable said power unit, said method comprising configuring said control unit to detect an electrostatic trip event and, in the event of a trip event being detected, to disable said power unit, said method being characterised by configuring said control unit to distinguish between a true trip event and a false trip event by comparing the time period of each trip event with a first predetermined time period and comparing the time period between successive trip events with a second predetermined time period, and identifying a true trip event where at least one of successive trip events has a time period greater than said first predetermined time period and the time between the successive trip events is less than said second predetermined time period.

2. A continuous inkjet printer having an electrostatic deflection facility operable to create an extra high tension (EHT) field to deflect charged ink droplets; a power unit operable to power said electrostatic facility; and a control unit operable to enable said power unit, said control unit being configured to detect an electrostatic trip event and, in the event of a trip event being detected, to disable said power unit, said printer being characterised in that said control unit is configured to distinguish between a true trip event and a false trip event by comparing the time period of each trip event with a first predetermined time period and comparing the time between successive trip events with a second predetermined time period, and identifying a true trip event where at least one of successive trip events has a time period greater than said first predetermined time period and the time between the successive trip events is less than said second predetermined time period.

* * * * *